United States Patent [19]

Zimmer

[11] Patent Number: 4,865,199

[45] Date of Patent: Sep. 12, 1989

[54] DISPOSABLE COMBINATION CUP AND BASE

[76] Inventor: John Zimmer, 2450 Antietam, Ann Arbor, Mich. 48105

[21] Appl. No.: 755,052

[22] Filed: Jul. 12, 1985

[51] Int. Cl.[4] ..... B65D 21/02; A47G 19/03

[52] U.S. Cl. ..... 206/515; 206/514; 220/69; 220/85 H; 229/1.5 H

[58] Field of Search ..... 206/514, 515, 519; 220/69, 85 H; 229/1.5 H

[56] References Cited

U.S. PATENT DOCUMENTS

| | | | |
|---|---|---|---|
| 2,028,566 | 1/1936 | Seipel | 229/1.5 H |
| 2,041,573 | 5/1936 | Meinecke . | |
| 2,235,502 | 3/1941 | Leppke . | |
| 2,576,725 | 11/1951 | Schoelles . | |
| 2,729,956 | 1/1956 | Gilbert . | |
| 3,207,461 | 9/1965 | Holzwarth et al. . | |
| 3,246,786 | 4/1966 | Holley . | |
| 3,337,109 | 8/1967 | Shumrak . | |
| 3,371,819 | 3/1968 | Zeman | 220/69 |
| 3,372,830 | 3/1968 | Edwards | 206/519 |
| 3,596,795 | 3/1971 | D'Ercoli | 206/514 |
| 3,954,178 | 5/1976 | Mason, Jr. . | |
| 3,971,471 | 7/1976 | Ludder | 206/519 |
| 4,548,348 | 10/1985 | Clements | 206/514 |

FOREIGN PATENT DOCUMENTS

| | | | |
|---|---|---|---|
| 1214726 | 4/1960 | France | 220/59 |
| 2247391 | 5/1975 | France | 220/69 |

*Primary Examiner*—George E. Lowrance
*Attorney, Agent, or Firm*—Brooks & Kushman

[57] ABSTRACT

A disposable combination (10) of an expanded foam cup (12) and an expanded base (14) is disclosed for preventing tipping of the cup and spilling of its contents. The disposable cup (12) has a frusoconical side wall (16) with an upper portion (18) having an open upper end (20) and with a lower end (24) closed by a round bottom (28). The base (14) has a frustoconical shape that coverages in an upward direction in its use position and has the same size and shape as the upper portion (18) of the cup side wall (16) so as to be stackable prior to use. Frustoconical base (14) has a lower end (30) on which the base rests in its use position and has an upper open end (34) that receives the cup during use. Between the upper and lower ends, the frustoconical base (14) has a height according to a prescribed equation that positions the cup bottom (28) and the lower base end (30) in a coplanar relationship to provide the support that prevents the cup from tipping during use.

9 Claims, 1 Drawing Sheet

DISPOSABLE COMBINATION CUP AND BASE

TECHNICAL FIELD

This invention relates to a disposable combination cup and base that cooperate to prevent tipping of the cup and consequent spillage of its contents.

BACKGROUND ART

Many disposable cups have a frustoconical shape made from expanded foam, paper, or plastic with a construction having a lower closed end that is smaller than the upper open end. While this frustoconical cup construction is desirable from the standpoint of stackability, feel, and the ability to hold a greater volume than a cylindrical shape with the same size as the lower end of the cup, the frustoconical shape makes the containers susceptible to tipping when filled with liquid contents. This instability is a particular problem in moving vehicles where any change in momentum, both upon acceleration or deceleration, will cause the frustoconical cups to tip over and spill their contents unless positioned in a special holder. Even normal vehicle acceleration, deceleration upon braking, or cornering can produce enough change in momentum to tip over frustoconical cups.

The prior art discloses many disposable cups that require a holder for use. One such cup is disclosed by the U.S. Pat. No. 3,337,109 of Shumrak which discloses two embodiments of a cup holder. One of the embodiments has a cylindrical shape while the other has a frustoconical shape. Both of these cup holder embodiments are designed to support an associated cup just below an outwardly projecting rim at its upper open end and neither is disclosed as being stackable with the associated cups.

Other containers and container holders are disclosed by U.S. Pat. Nos.: 2,041,573 Meinecke; 2,235,502 Leppke; 2,576,725 Schoelles; 2,729,956 Gilbert; 3,207,461 Holzwarth et al; 3,246,786 Holley; and 3,954,178 Mason, Jr.

DISCLOSURE OF INVENTION

An object of the present invention is to provide a disposable combination cup and base that are usable to prevent tipping of the cup and consequent spillage and which are stackable to facilitate shipment and storage prior to use.

In carrying out the above object and other objects of the invention, the disposable combination cup and base includes a disposable expanded foam cup having a frustoconical side wall that diverges in an upward direction. This side wall includes an upper portion with an upper end having a major diameter $D_1$ and also includes a lower portion with a lower end having a minor diameter $D_2$. The side wall has a wall thickness T and has a height H between its upper and lower ends. The disposable cup also has a round bottom that closes the lower end of the side wall and has a diameter equal to the minor diameter of the side wall.

A frustoconical expanded foam base of the disposable combination cup and base converges in an upward direction in a use position thereof and has the same size and shape as the upper portion of the cup side wall so as to be stackable therewith prior to use. The base has a lower end on which the base rests in its use position and has an open upper end that receives the cup. The base has a height h according to the equation:

$$h = \frac{H}{2} - \left(\frac{T \times H}{D_1 - D_2}\right)$$

The construction of the base in accordance with the above equation provides positioning of the bottom of the cup and the lower end of the base in a coplanar relationship to provide support that prevents the cup from tipping over during use.

Use of the disposable combination cup and base can be enhanced by securing the open upper end of the base to the side wall of the cup. This securement is most preferably provided by an adhesive that extends between the open upper end of the base and the side wall of the cup. This adhesive can be of the type that is activated by wetting and applied to the upper open end of the base and/or the side wall of the cup at appropriate locations to provide the securement. The adhesive can also be of other types that are applied to the open upper end of the base prior to the insertion of the cup into the base so as to provide the proper location of the contact of the adhesive with the cup side wall.

A plurality of the disposable combination cups and bases are arranged in a stacked relationship to facilitate shipment and storage prior to use. In one version of the stacking, the combination cups and bases alternate with each other so that the stack always presents a cup and base at each end ready for use. In another version, the cups are stacked with each other and the bases are stacked with each other, with the stack of cups stacked with the stack of bases. In this latter stacking arrangement, the user pulls a cup from one end of the stack and a base from the other end of the stack if the base is desired for use with the cup.

The objects, features, and advantages of the present invention are readily apparent from the following detailed description of the best modes for carrying out the invention when taken in connection with the accompanying drawings.

BEST MODES FOR CARRYING OUT THE INVENTION

Figure 1:
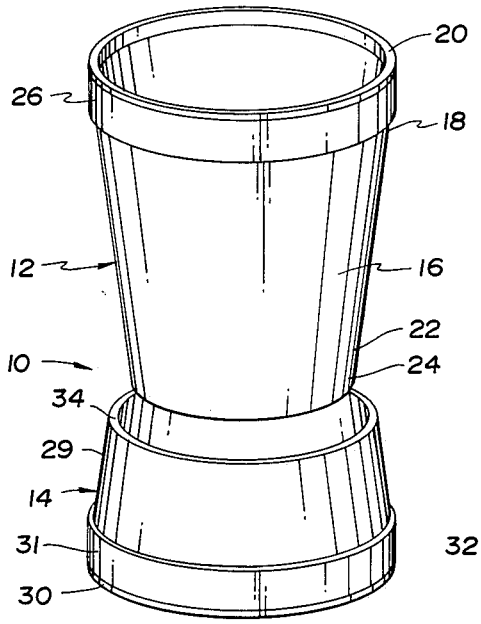
FIG. 1 is a perspective view illustrating a disposable combination cup and base illustrated with the cup just prior to insertion into the base.
Figure 2:
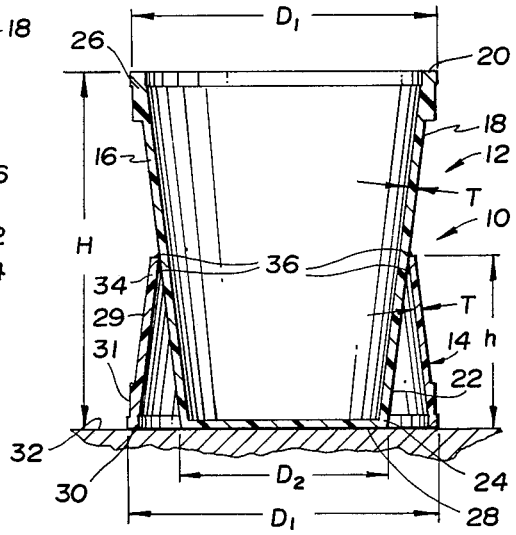
FIG. 2 is a vertical sectional view through the disposable combination cup and base after the cup has been inserted into the base ready for use.

With reference to FIGS. 1 and 2 of the drawings, a disposable combination cup and base constructed in accordance with the present invention is generally indicated by 10 and includes a disposable frustoconical expanded foam cup 12 that is supported by a frustoconical expanded foam base 14 after movement of the cup from the position of FIG. 1 to the inserted position of FIG. 2. This inserted relationship of the cup 12 into the base 14 prevents the cup from tipping over and spilling its contents. As is hereinafter more fully described, the cup 12 and base 14 are also constructed so as to be stackable for shipment and storage prior to use.

As best illustrated in FIG. 2, the disposable cup 12 has a frustoconical side wall 16 that diverges in an upward direction. The cup 12 includes an upper portion 18 with an open upper end 20 having a major diameter $D_1$. Side wall 16 also has a lower portion 22 with a lower end 24 having a minor diameter $D_2$ that is preferably approximately two-thirds of the major diameter $D_1$. Side wall 16 has a wall thickness T and a height H between the upper and lower ends 20 and 24 that is preferably just slightly greater than the major diameter $D_1$. At the upper end 20, the cup side wall 16 has a rim 26 of a greater thickness than the side wall thickness T to thereby provide increased rigidity to the cup. A round bottom 28 of disposable cup 12 closes the lower end 24 of the side wall 16 as illustrated in FIG. 2 and has a diameter equal to the minor diameter $D_1$ of the side wall.

Figure 3:
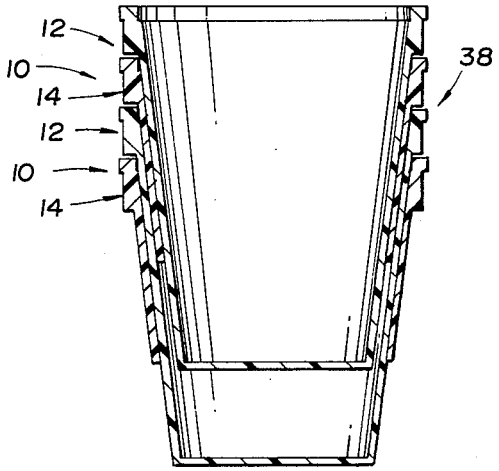
FIG. 3 is an elevation view taken in section through one embodiment of a stack of the cups and bases.
Figure 4:
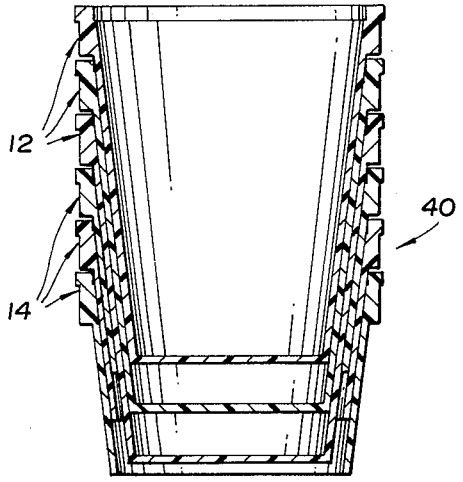
FIG. 4 is an elevation view taken in section through another embodiment of a stack of the combination cups and bases.

As best illustrated in FIGS. 1 and 2, the frustoconical base 14 converges in an upward direction in the use position thereof as shown. The base 14 has the same size and shape as the upper portion of the cup side wall 16 so as to be stackable therewith as illustrated in FIGS. 3 and 4 which are hereinafter more fully described. Base 14 has a side wall 29 with a thickness T equal to the cup side wall thickness and has a lower end 30 including a rim 31 on which the base rests in its use position such as on the support surface 32 illustrated. The lower base end rim 31 has a greater thickness than the rest of the base side wall 29 to thereby provide increased rigidity to base 14 in an identical manner as the cup rim 26. In addition, the base 14 has an upper open end 34 that receives the cup 12 upon downward movement thereof from the position of FIG. 1 to the inserted position of FIG. 2. Between its lower and upper ends 30 and 34, base 14 has a height h according to the equation:

$$h = \frac{H}{2} - \left(\frac{T \times H}{D_1 - D_2}\right)$$

The construction of the cup 12 and base 14 as described above with the base height in accordance with the above equation positions the bottom 28 of the cup and the lower end 30 of the base in a coplanar relationship. This coplanar relationship provides support of the cup and base on any surface, such as the surface 32 illustrated, in a manner that maintains the center of gravity of the filled cup as low as possible and prevents the cup from tipping over during use. In fact, at least twice as much energy is required to tip over the disposable combination cup and base 10 with the proportions discussed above as compared to a cup 12 without the base 14.

It should be appreciatd that the equation described above in selecting the height h of the base 14 in order to achieve the coplanar relationship of the cup bottom 28 and the lower base end 30 does not account for any compression that may take place between the engaged cup side wall 16 and the upper base end 34. If there is substantial compression, the base height may have to be just slightly greater than the height calculated according to the equation. Furthermore, this equation assumes that the cup side wall 16 is of a thin-wall construction which means that its thickness T is very small in relationship to the major and minor diameters $D_1$ and $D_2$ — i.e. the ratio of $D_2$ over T being at least 10.

As best illustrated in FIG. 2, an adhesive 36 provides a preferred means for further securing the open upper end 34 of the base 14 to the cup side wall 16 in order to fix the relationship therebetween with the cup bottom 28 and the lower base end 30 in the coplanar relationship previously described. This adhesive 36 may be of a type that is activated by wetting and applied at appropriate locations on the cup side wall 16 and/or the upper base end 34 upon manufacturing. Similarly, it is possible to apply any type of adhesive to the upper base end 34 just prior to use such that the adhesive is then properly located upon insertion of the cup 12 into the base 14.

With reference to FIGS. 3 and 4, two different arrangements of stacks 38 and 40 are illustrated of the cups 12 and the bases 14. These cups and bases are arranged in both versions in a stacked relationship to facilitate shipment and storage prior to use. In the stack 38 of FIG. 3, the cups 12 and bases 14 alternate with each other which allows the consumer to easily remove both a cup and a base from either the top or the bottom of the stack. In the stack 40 of FIG. 4, the cups 12 are stacked with each other and the bases 14 are stacked with each other, and the stack of cups are stacked with the stack of bases. This latter stacking arrangement permits the stacking of a certain number of the combination cups and bases without increasing the overall height of the stack.

While the best modes for carrying out the invention have been described in detail, those familiar with the art to which this invention relates will recognize various alternative designs and embodiments for practicing the invention as defined by the following claims.

What is claimed is:

1. A disposable combination cup and base comprising:

a disposable cup made of expanded foam and having a frustoconical wall that diverges in an upward direction and has a generally uniform thickness; said side wall including an upper portion with an open upper end having a major diameter $D_1$ and also including a lower portion with a lower end having a minor diameter $D_2$; said open upper end of the cup including an outwardly projecting rim of a greater thickness than the uniform thickness of the side wall; said side wall having a wall thickness T and having a height H between the upper and lower ends thereof; and said disposable cup having a round bottom that closes the lower end of the side wall and has a diameter equal to the minor diameter of the side wall; and a frustoconical base made of expanded form and having a side wall of a generally uniform thickness that converges in an upward direction in a use position thereof; said base having the same size and shape as the upper portion of the cup side wall so as to be stackable therewith; said base having a lower end on which the base rests in its use position and having an open upper end that receives the cup; said lower end of the base having an outwardly projecting rim of a greater thickness than the uniform thickness of the side wall of the base and of the same size and shape as the rim of the cup; and said base having a height h between the upper and lower ends thereof according to the equation:

$$h = \frac{H}{2} - \left(\frac{T \times H}{D_1 - D_2}\right)$$

whereby the bottom of the cup and the lower end of the base are coplanar to provide support that prevents the cup from tipping over during use.

2. A disposable combination cup and base as in claim 1 further including means for securing the open upper end of the base to the side wall of the cup.

3. A disposable combination cup and base as in claim 2 wherein an adhesive comprises the means for securing the open upper end of the base to the side wall of the cup.

4. A plurality of the disposable combination cups and bases as in claim 1 wherein the cups and bases are arranged in a stacked relationship to facilitate shipment and storage prior to use.

5. A stack of the disposable combination cups and bases as in claim 4 wherein the cups and bases alternate with each other.

6. A stack of the disposable combination cups and bases as in claim 4 wherein the cups are stacked with each other and the bases are stacked with each other, and with the stack of cups stacked with the stack of bases.

7. A stack of disposable combination cups and bases, each combination cup and base comprising: a disposable cup made of expanded foam and having a frustoconical side wall that diverges in an upward direction and has a generally uniform thickness; said side wall including an upper portion with an open upper end having a major diameter $D_1$ and also including a lower portion with a lower end having a minor diameter $D_2$; said open upper end of the cup including an outwardly projecting rim of a greater thickness than the uniform thickness of the side wall; said side wall having a wall thickness T and having a height H between the upper and lower ends thereof; and said disposable cup having a round bottom that closes the lower end of the side wall and has a diameter equal to the minor diameter of the side wall; and a frustoconical base made of expanded foam and having a side wall of a generally uniform thickness; said base converging in an upward direction in a use position thereof and having the same size and shape as the upper portion of the cup side wall so as to be stackable therewith; said base having a lower end on which the base rests in its use position and having an open upper end that receives the cup; said lower end of the base having an outwardly projecting rim of a greater thickness than the uniform thickness of the side wall of the base and of the same size and shape as the rim of the cup; and said base having a height h between the upper and lower ends thereof according to the equation:

$$h = \frac{H}{2} - \left(\frac{T \times H}{D_1 - D_2}\right)$$

whereby the bottom of the cup and the lower end of the base are coplanar to provide support that prevents the cup from tipping over during use.

8. A stack of the disposable combination cups and bases as in claim 7 wherein the cups and bases alternate with each other.

9. A stack of the disposable combination cups and bases as in claim 9 wherein the cups are stacked with each other and the bases are stacked with each other, and with the stack of cups stacked with the stack of bases.

* * * * *

UNITED STATES PATENT AND TRADEMARK OFFICE

CERTIFICATE OF CORRECTION

PATENT NO. : 4,865,199

DATED : September 12, 1989

INVENTOR(S) : John Zimmer

It is certified that error appears in the above-identified patent and that said Letters Patent is hereby corrected as shown below:

Abstract, Column 2, line 2, after "expanded" and before "base" insert --foam--.

Column 4, line 55, claim 1, "form" should be --foam--.

Column 6, line 33, claim 9, "9" should be --7--.

Signed and Sealed this

Fourth Day of December, 1990

*Attest:*

HARRY F. MANBECK, JR.

*Attesting Officer*

*Commissioner of Patents and Trademarks*